United States Patent [19]

Matsuo et al.

[11] Patent Number: 4,989,555

[45] Date of Patent: Feb. 5, 1991

[54] LUBRICANT SUPPLY FOR TWO CYCLE ENGINE

[75] Inventors: Noritaka Matsuo; Hideaki Ito, both of Iwata, Japan

[73] Assignee: Yamaha Hatsudoki Kabushiki Kaisha, Iwata, Japan

[21] Appl. No.: 472,341

[22] Filed: Jan. 30, 1990

[30] Foreign Application Priority Data

Feb. 1, 1989 [JP] Japan ..... 1-20820

[51] Int. Cl.[5] ..... F01M 1/00

[52] U.S. Cl. ..... 123/73 AD; 123/196 R

[58] Field of Search ..... 123/73 AD, 196 R

[56] References Cited

U.S. PATENT DOCUMENTS 3,886,914 6/1975 Ahrns et al. ..... 123/73 AD 4,411,225 10/1983 Dell'Orto ..... 123/73 AD 4,573,932 3/1986 DuBois ..... 123/73 AD 4,765,291 8/1988 Kurio et al. ..... 123/73 AD

*Primary Examiner*—E. Rollins Cross

*Attorney, Agent, or Firm*—Ernest A. Beutler

[57] ABSTRACT

An apparatus and method for maintaining the control of lubricant to a two cycle engine so as to provide adequate lubrication without over lubrication and deleterious exhaust conditions, such as smoke. The system includes a lubricant pump that has both its output and its timing of discharge variable. Under one range of running conditions, the normal conditions, the output of the pump is maintained constant and the timing of the output is varied. Under high speed, high load conditions, the time of operation of the pump is held constant and the output time of the pump is varied.

14 Claims, 3 Drawing Sheets

LUBRICANT SUPPLY FOR TWO CYCLE ENGINE

BACKGROUND OF THE INVENTION

This invention relates to a lubricant supply system for a two cycle engine and more particularly to an improved lubricating system and method for metering the amount of lubricant delivered to an engine.

It is well known that two cycle internal combustion engines are normally lubricated by means of a lubricating system that involves delivery of the lubricant to the engine for its lubrication and then burning of the excess lubricant in the combustion chamber and discharged to the atmosphere. This type of lubrication can be achieved either by mixing lubricant with the fuel or, alternatively, by supplying the lubricant to the engine by a separate lubricating system. It should be readily apparent that these types of arrangement make it essential that the amount of lubricant supplied to the engine is adequate but not excessive. That is, if excessive lubricant is supplied to the engine, the exhaust will contain a large amount of smoke. This is obviously undesirable. Even if smoke is not encountered, the emissions within the exhaust gases may be undesirable if the amount of lubricant supplied is too high.

With separate lubricating systems, it is the normal practice to employ some form of reciprocating positive displacement pump for delivering the lubricant. Such pumps have the advantage of being simple and yet offer the opportunity to accurately meter the amount of lubricant supplied. One way that the amount of lubricant delivered can be varied is by changing the stroke or volume of discharge of the oil pump with each operation. Normally, the system is such that the amount of stroke is increased as the load on the engine increases. However, when operating under high load, low speed conditions, the amount of oil fed per stroke is large and the oil feeding interval is also large. Therefore, there is a tendency to provide over lubrication and the disadvantages as aforenoted.

If the oil quantity delivered per stroke of the oil pump is decreased, it then becomes difficult to supply the required quantity of oil under high load, high speed range because the oil feeding interval must be significantly reduced to avoid the problems. It is also difficult for the oil pump to provide this control.

In addition to the aforenoted problems, it has been determined experimentally that the formation of oil particles within the combustion chamber and engine becomes a problem immediately after the oil feed. This tendency becomes significant as the oil feeding quantity per stroke of the pump is increased. It is, of course, desirable to reduce oil particle generation so as to insure that the lubricant is properly utilized and so that the aforenoted problems do not occur.

It is, therefore, a principal object of this invention to provide an improved arrangement for controlling the amount of lubricant supplied to an engine during its operation so that adequate lubricant is supplied under all running conditions and so that excess lubricant is never supplied.

It is a further object of this invention to provide an improved, simplified and yet highly effective arrangement for controlling the amount of lubricant supplied to an engine.

It is a further object of this invention to provide an improved lubricating system and method for lubricating a two cycle engine having a separate lubricating system.

SUMMARY OF THE INVENTION

This invention is adapted to be embodied in a lubricating system for a reciprocating machine that comprises a cyclically operable lubricant pump having a variable output per cycle and means for varying the operating speed of the pump for varying the time of output of the pump. Control means are provided for maintaining the pump output constant and the timing of output variable under one range of running conditions and for holding the time of operation of the pump constant and varying the output per stroke within another range of running operations.

DETAILED DESCRIPTION OF THE PREFERRED EMBODIMENT OF THE INVENTION

Figure 1:
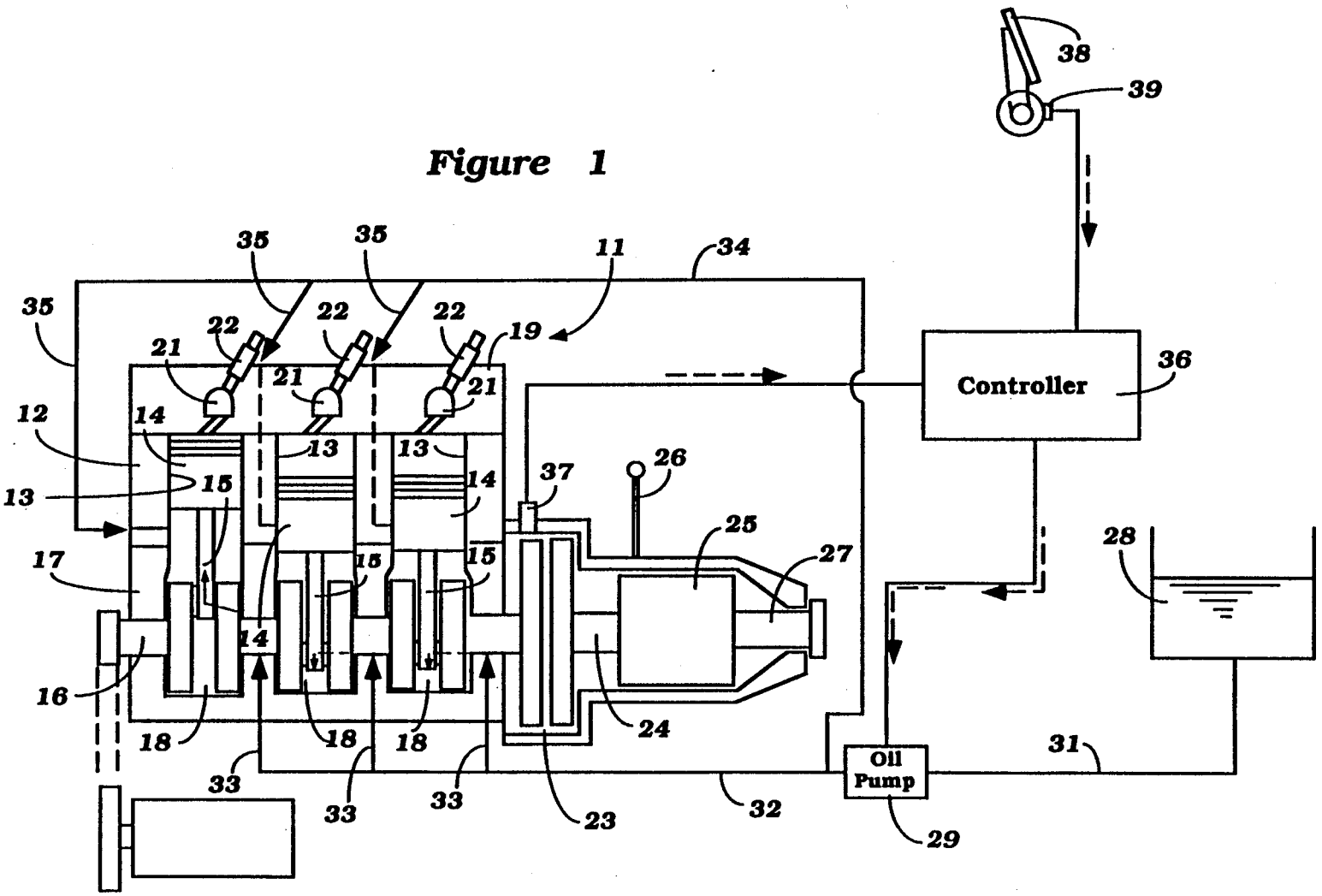
FIG. 1 is a partially schematic cross sectional view of a lubricating system for a two cycle internal combustion engine constructed in accordance with an embodiment of the invention.

Referring first to FIG. 1, an internal combustion engine lubricated in accordance with a system and method embodying the invention is identified generally by the reference numeral 11. In the illustrated embodiment, the engine is of the two stroke, crankcase compression, diesel type. It is to be understood, however, that the invention may be utilized in conjunction with other types of engines. However, the invention has particular utility in conjunction with two cycle engines.

In the illustrated embodiment, the engine 11 is of the in line three cylinder type and includes a cylinder block 12 having three cylinder bores 13 in which pistons 14 reciprocate. The pistons 14 are connected by means of connecting rods 15 to a crankshaft 16 that is journaled for rotation between the cylinder block 12 and a crankcase 17 in a known manner.

The crankcase 17 forms individual crankcase chambers 18 that are associated with each of the pistons 14 and cylinder bores 13 and to which an air charge is admitted in a known manner. This may include an induction system of a suitable type and reed type check valves, as is well known with this type of engine.

The charge which is admitted to the crankcase chambers 18 during the upstroke of the pistons 14 is then compressed and transferred to the combustion chambers formed above the heads of the pistons 15 and in part by a cylinder head assembly 19 through suitable scavenge ports (not shown).

The cylinder head assembly 19 is provided with precombustion swirl chambers 21 into which a charge of fuel is injected by respective fuel injection nozzles 22.

This fuel is delivered to the nozzles 22 in a suitable manner from an injection system not shown. In addition, there may be provided glow plugs in the precombustion chambers 21 for starting purposes.

When the pistons 14 approach their top dead center position and fuel injection into the precombustion chambers 21 is initiated by the nozzles 22, the fuel will burn, expand and enter the main combustion chambers and drive the pistons 14 downward. The exhaust gases are then discharged through exhaust ports (not shown) that are opened during the descent of the pistons 14.

The construction of the engine 11 and its systems as thus far described may be considered to be conventional. For this reason, further description is not believed to be necessary. As should be readily apparent, the invention deals with the lubrication system for the engine. This lubrication system may be utilized with any basic type of engine, but particularly those operating on the two stroke cycle.

In the illustrated embodiment, the engine 11 is of the automotive type and hence is utilized in conjunction with a clutch 23 which can be selectively engaged to drive the input shaft 24 of a change speed transmission 25. The ratios of the transmission 25 are controlled by a shift lever 26 to drive an output shaft 27 at variable speeds.

Turning now to the lubricating system, this comprises a lubricant reservoir 28 that supplies lubricant to a lubricant pump 29 through a conduit 31. The lubricant pump 29 is operated in a manner which will be described and supplies lubricant to a main supply conduit 32. The conduit 32 supplies oil to lubricate the main bearings of the crankshaft 16 through individual lubricant passages 33. In addition, a conduit 34 interconnects the output from the lubricant pump 29 to a plurality of individual passageways 35 that terminate in spray nozzles which lubricate the pistons 14. Other components of the engine may be lubricated in a suitable manner.

The oil pump 29 is controlled, by a control strategy to be described, from a controller 36 that receives an input signal indicative of engine speed from a pick up 37 that cooperates with the driving disk of the clutch 23. In addition, a throttle control 38 of the engine is associated with a potentiometer 39 that inputs a signal to the controller 36 indicative of throttle position (load).

Although the described control strategy employs throttle position opening and engine speed as parameters for detecting engine operating condition, further control parameters may also be employed such as cooling water temperature, intake air temperature, and other such factors as are well known.

Figure 2:
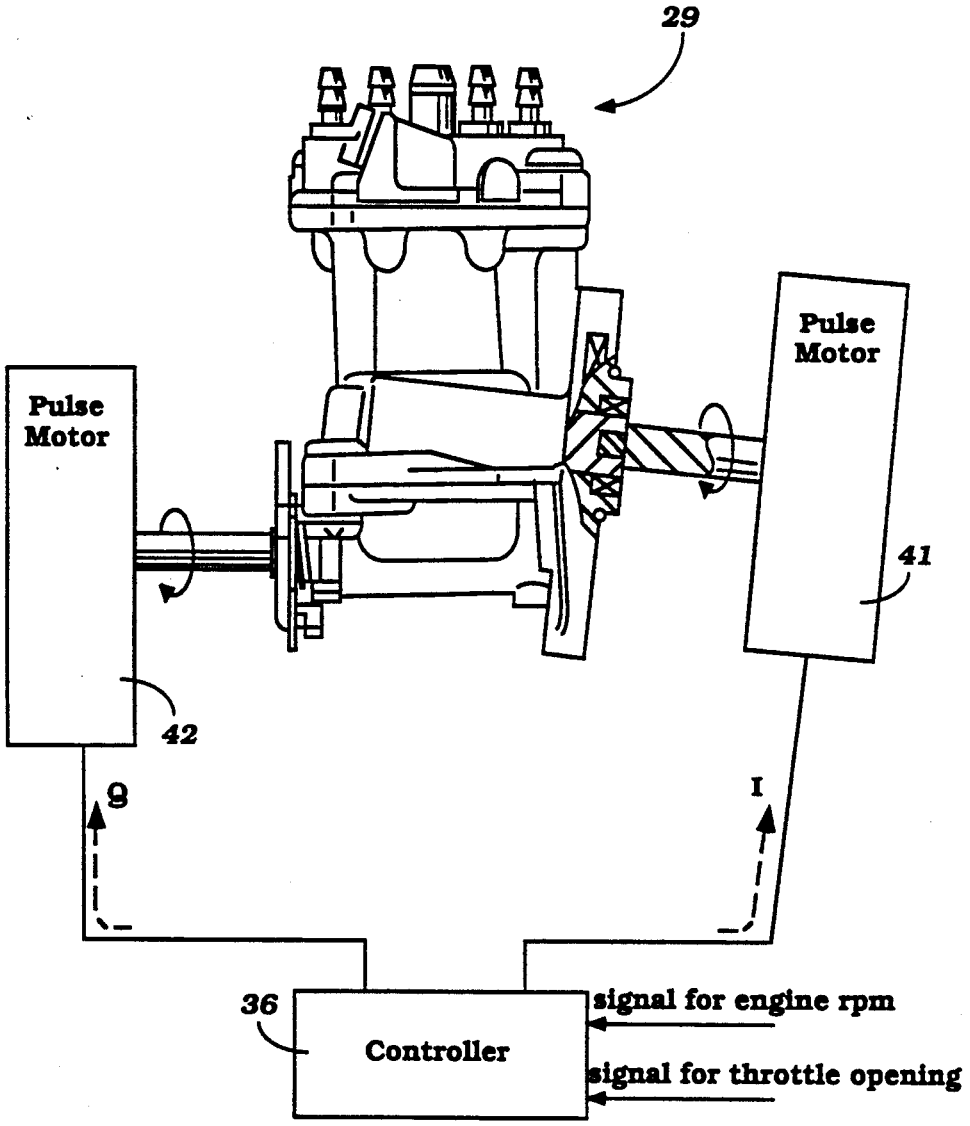
FIG. 2 is an enlarged side elevational view, with a portion broken away, and other portions shown in section of a control arrangement and fuel injection pump embodying the invention.

Turning now to FIG. 2, it will be noted that the fuel injection pump 29 is of the reciprocating type and is comprised of plurality of individual pistons that are driven by an electric pulse motor 41 so as to regulate the interval I of fuel injection.

In addition, there is provided a further pulse motor 42 that is operative to control the stroke of the individual pistons and hence the quantity Q of lubricant delivered to the engine. As a result, both the stroke and duration of injection are controlled with this system. Although a specific injection pump 29 is not described, the type of injection pump that can be utilized to practice this invention is well known and further description is not believed to be necessary.

Figure 3:
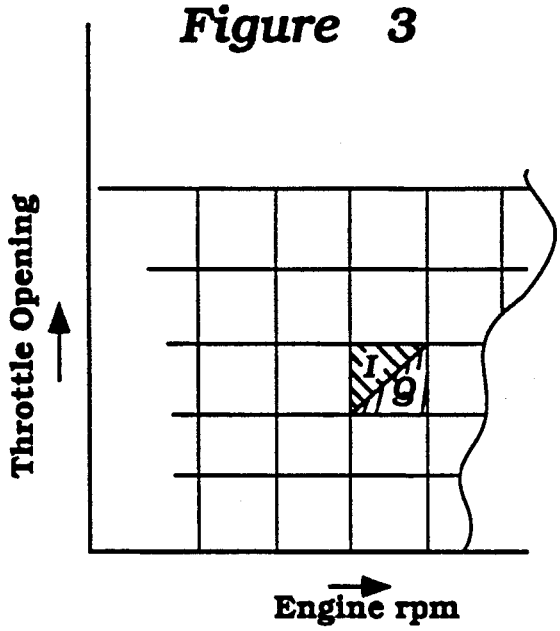
FIG. 3 is a map showing the arrangement for determining the oil feed per stroke of the pump and the oil feeding interval of the oil pump according to the engine operating conditions.
Figure 4:
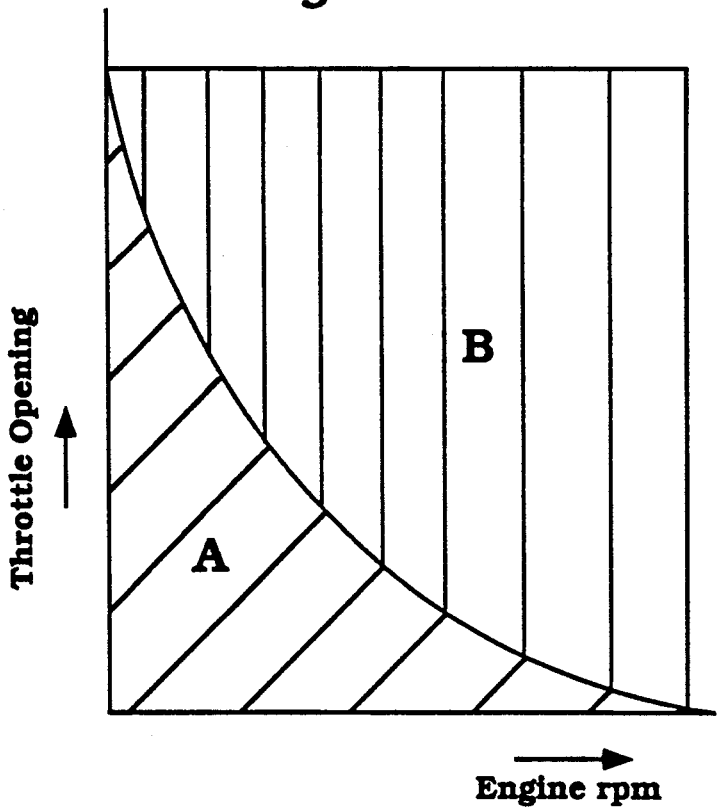
FIG. 4 is a graphic view showing the range in running condition of the engine wherein the various controls are applied.

The basic strategy of operation of the fuel injection system is that for a given throttle opening and engine speed, the controller 36 is programmed in accordance with a map as shown in FIG. 3 wherein both the injection timing I and stroke or quantity Q are controlled in accordance to the preset map. The strategy followed by the map may be best understood by reference to FIG. 4, wherein a curve of throttle opening and engine RPM is depicted. There is a curved line which divides the strategy into the area A and the area B. The area A is the normal or ordinary operating range which is outside of the high load, high speed range. Under this condition, the oil feeding quantity required is secured by adjusting the oil feeding interval I while fixing the oil feeding quantity per stroke Q at its minimum value. In this way, it can be possible to suppress the formation of oil particles in the discharge and insure that the lubrication is adequate but not excessive. On the other hand, when operating in the high speed, high load range (area B), then the quantity of oil per stroke is adjusted by setting the oil feeding quantity Q per stroke while fixing the oil feeding interval I at its practical minimum. This is done because even with high load, high speed operation, the small quantity of oil needed per stroke cannot be reasonably set by varying the oil feeding interval. Thus, the oil fed per stroke Q can be kept at a minimum and the performance will be optimized.

It should be readily apparent from the foregoing description that the described control system and structure permits adequate amount of lubricant to be supplied to the engine under all running conditions without having excess lubricant that can give rise to detrimental exhaust characteristics. Of course, the foregoing description and control strategy is only a preferred embodiment of the invention. Various changes and modifications may be made without departing from the spirit and scope of the invention, as defined by the appended claims.

We claim:

1. In a lubricating system for a reciprocating machine comprising a cyclically operable lubricant pump having a variable output per cycle, and means for varying the speed of said pump for varying the timing of said output, and control means for maintaining the output of said pump constant and the timing of the output variable under one range of running conditions and for holding the timing of operation constant and varying the output stroke within another range of engine operation.

2. In a lubricating system as set forth in claim 1 wherein the one range of running conditions is the normal running condition.

3. In a lubricating system as set forth in claim 2 wherein the output of the pump is maintained at a minimum output during the one range of conditions.

4. In a lubricating system as set forth in claim 3 wherein the other range of running conditions is high speed, high load.

5. In a lubricating system as set forth in claim 4 wherein the output of the pump is maintained at a minimum during the other range of operation.

6. In a lubricating system as set forth in claim 1 wherein the other range of running conditions is high speed, high load.

7. In a lubricating system as set forth in claim 6 wherein the output of the pump is maintained at a minimum during the other range of operation.

8. The method of controlling a lubricating system for a reciprocating machine having a cyclically operable lubricant pump having a variable output per cycle, and means for varying the speed of said pump for varying the timing of said output, comprising the steps of maintaining the output of the pump constant and the timing of the output variable under one range of running conditions and for holding the timing of operation constant and varying the output stroke within another range of engine operation.

9. The method as set forth in claim 8 wherein the one range of running conditions is the normal running condition.

10. The method as set forth in claim 8 wherein the output of the pump is maintained at a minimum output during the one range of conditions.

11. The method as set forth in claim 10 wherein the other range of running conditions is high speed, high load.

12. The method as set forth in claim 11 wherein the output of the pump is maintained at a minimum during the other range of operation.

13. The method as set forth in claim 8 wherein the other range of running conditions is high speed, high load.

14. The method as set forth in claim 13 wherein the output of the pump is maintained at a minimum during the other range of operation.

* * * * *